United States Patent [19]

Tervamäki et al.

[11] Patent Number: 4,466,298

[45] Date of Patent: Aug. 21, 1984

[54] THERMAL EXPANSION RESISTANT PIPETTE

[75] Inventors: Jukka Tervamäki, Helsinki; Erkki Kaski, Luvia; Mikael Fagerstedt; Aarre Kukka, both of Helsinki, all of Finland

[73] Assignee: Labsystems Oy, Helsinki, Finland

[21] Appl. No.: 386,269

[22] Filed: Jun. 8, 1982

[30] Foreign Application Priority Data

Jun. 17, 1981 [FI] Finland ..... 811915

[51] Int. Cl.[3] ..... B01L 3/02

[52] U.S. Cl. ..... 73/864.18; 222/309; 422/100

[58] Field of Search ..... 73/864.18, 864.16, 864.13; 222/309; 422/100

[56] References Cited

U.S. PATENT DOCUMENTS

| | | | |
|---|---|---|---|
| 3,882,729 | 5/1975 | Roach | 73/864.18 |
| 4,141,251 | 2/1979 | Oshikubo | 73/864.18 |
| 4,284,604 | 8/1981 | Tervamaki | 73/864.18 X |
| 4,294,125 | 10/1981 | Lee | 73/864.18 X |

FOREIGN PATENT DOCUMENTS

| | | | |
|---|---|---|---|
| 2261645 | 6/1974 | Fed. Rep. of Germany | 73/864.16 |

*Primary Examiner*—Gerald Goldberg
*Assistant Examiner*—Tom Noland
*Attorney, Agent, or Firm*—Hopgood, Calimafde, Kalil, Blaustein & Judlowe

[57] ABSTRACT

The subject of the invention is a pipette which comprises a frame portion (1) shaped as a handle, a cylinder being formed inside the frame portion (1), as well as a piston (5) fitted into the cylinder by means of a seal ring (7), a piston rod (4) connected to the piston (3), as well as a press knob (5) with shaft (6), fitted at the upper end of the frame portion (1). Around the shaft (6) of the press knob (5), a calibration sleeve (9) is fitted by means of a threaded joint (8), by means of which calibration sleeve (9) the lower limit of the movement of the piston (3) during pipetting can be determined. According to the invention, the calibration sleeve (9), as surrounded by the mantle (10) of the hollow press knob (5) and by the upper part of the pipette frame (1), is placed at a distance both from the mantle (10) of the press knob (5) and from the inner face of the cover of the upper part of the pipette frame (1). Thereby the hollow press knob (5) and the pipette frame (1) form a cover protecting from conducted heat and allow a space of air around the adjustment and calibration sleeve (9).

9 Claims, 7 Drawing Figures

THERMAL EXPANSION RESISTANT PIPETTE

BACKGROUND OF THE INVENTION

The subject of the present invention is a pipette which comprises a frame portion shaped as a handle, a cylinder being formed inside the frame portion, as well as a piston fitted into the cylinder by means of a seal ring, a piston rod connected to the piston, as well as a press knob with shaft, fitted at the upper end of the frame portion, and that, around the shaft of the press knob, a calibration sleeve is fitted by means of a threaded joint, by means of which calibration sleeve the lower limit of the movement of the piston during pipetting can be determined.

In prior art, numerous pipettes are known that can be calibrated precisely to the desired volume, e.g., the pipettes disclosed in the Finnish Pat. Nos. 57,542 and 57,543. These pipettes, however, involve the drawback that the heat conducted from the operator's hand expands the frame of the pipette, into which the adjusting and calibrating members are fitted, whereby the precision of the adjustment and calibration is no longer reliable.

SUMMARY OF THE INVENTION

It is an object of the present invention to eliminate the said lack of precision, and the pipette in accordance with the invention is mainly characterized in that the calibration sleeve, as surrounded by the mantle of the hollow press knob and by the upper part of the pipette frame, is placed at a distance both from the mantle of the press knob and from the inner face of the cover of the upper part of the pipette frame, whereby the hollow press knob and the pipette frame form a cover protecting from conducted heat and allow a space of air around the adjustment and calibration sleeve.

Thus, according to the invention, in the pipette, the calibration means is fitted on the knob shaft underneath the hollow knob as separated from contact with the knob cover and with the pipette frame, so that an adequate air space is allowed around the adjustment and calibration means, whereby heat cannot be conducted and expand the said means readily. Moreover, the pipette can be easily re-calibrated by pulling the knob apart from its friction joint.

A calibration means in accordance with the invention can be fitted to pipettes that are either continuously or stepwise calibrable or calibrable to a fixed volume. The pipette may also include a so-called secondary movement for complete emptying of the tip vessel, or it may not have a secondary movement, which is the case in so-called positive displacement pipettes.

BRIEF DESCRIPTION OF THE DRAWINGS

The invention comes out more closely from the following description and from the attached drawing, wherein.

DESCRIPTION OF THE PREFERRED EMBODIMENTS

Figure 4:
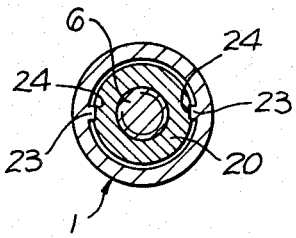
FIG. 4 shows a section at C-C in FIG. 1.

In the frame part 1, formed as the handle of the pipette, there is the cylinder 2, into which a piston 3 is fitted by means of a seal ring 7. The seal ring 7 is kept in position in its groove by a ring flange 15 fitted above the ring, which ring flange is pressed downwards by a spiral spring 16 fitted around the piston rod 4 between the ring flange 15 and a flange portion 17 at the upper end of the piston rod 4. A disposable tip vessel 19 is attached to the lower end of the tip tube 18 connected to the lower part of the cylinder 2 in the frame part 1 of the pipette. The upper end of the piston rod 4 is depressed against the lower end of the shaft 6 of the press knob 5. A sleeve 20 is fitted by means of a threaded joint 21 around the shaft 6 of the press knob. Inside the frame portion 1 of the pipette, there is an annular limiter flange 22, against whose lower face the sleeve 20 rests by means of its upper face. In this way, the sleeve 20 together with the annular flange 22 determines the upper position of the piston 3. As comes out from FIGS. 1 and 4, the inside of the frame portion 1 of the pipette is provided with longitudinal guides 23, and the sleeve 20 is provided with notches 24 corresponding to the said guides 23, whereby the guides 23 and the notches 24 prevent rotation of the sleeve 20 in relation to the frame portion 1 of the pipette, but permit axial gliding of the sleeve 20 inside the frame portion 1 of the pipette.

Figure 1:
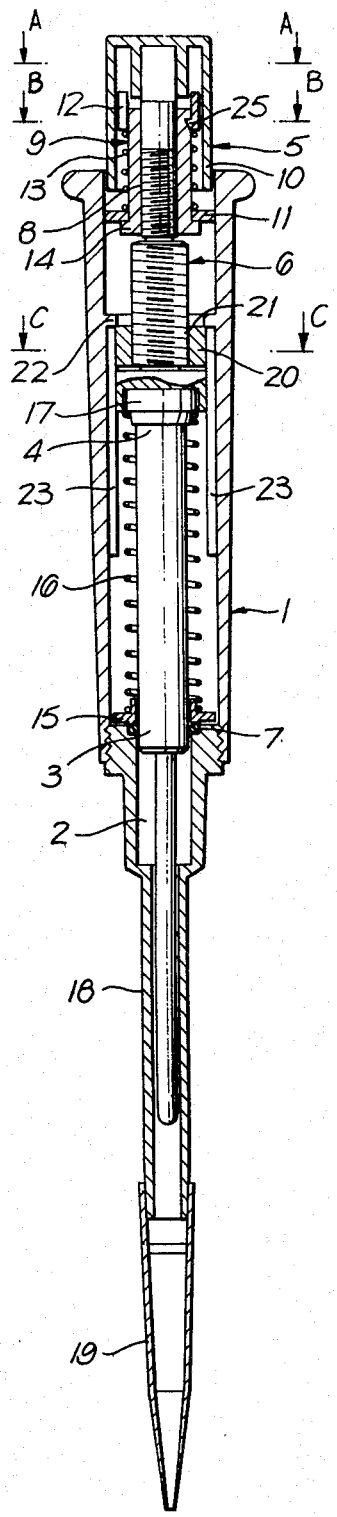
FIG. 1 is a sectional side view of a pipette provided with a calibration solution in accordance with the invention.
Figure 3:
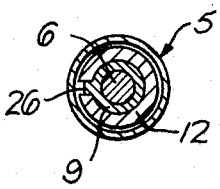
FIG. 3 shows a section at B-B in FIG. 1.

Above the adjustment thread 21 of the press knob shaft 6, on the press knob shaft 6 there is the calibration thread 8. The diameter and the pitch of the calibration thread 8 may be either the same as or different from those of the adjustment thread 21. By means of the calibration thread, a calibration sleeve 9 is fitted around the shaft 6 of the press knob 5, by means of which sleeve 9 the lower limit of the movement of the piston 3 during pipetting can be determined. As surrounded by the mantle 10 of the hollow press knob 5 and by the upper portion of the pipette frame 1, the calibration sleeve 9 is placed at a distance both from the mantle 10 of the press knob 5 and from the inner face of the cover of the upper part of the pipette frame 1. In such a case, the hollow press knob 5 and the pipette frame 1 constitute a protective cover against conducted heat and allow a sufficient air space around the adjustment and calibration sleeve 9. For the secondary movement of the pipette, an annular flange 11 is fitted in the annular space between the calibration sleeve 9 and the pipette frame 1, around the calibration sleeve 9, which annular flange 11 is pressed downwards against a limiter flange 14 placed at the lower portion of the calibration sleeve 9 by a spiral spring 13 placed around the calibration sleeve 9 and fitted between the said annular flange 11 and a ring piece 12 attached to the upper end of the calibration sleeve 9. As comes out from FIG. 3, the ring piece 12 is cut off at one point, and, as the ring piece 12 and the calibration sleeve 9 are, in the way coming out from FIG. 1, provided with jointly operative notches 25, the ring piece 12 can be readily attached to the upper end of the calibration sleeve 9 by just pressing. According to FIG. 3, there is a projection 26 at the upper end of the calibration sleeve 9 facing the ring piece 12, at which projection the cut-off point of the ring piece 12 is placed when the ring piece 12 is fitted to the end of the calibration sleeve 9. Thereby the projection 26 prevents the ring piece 12 from rotating in relation to the calibration sleeve 9. Thereby the calibration can be performed by means of the ring piece 12 by turning the calibration sleeve 9 around the shaft 6 of the press knob. The cylindrical outer face of the ring piece 12 is preferably provided with a pattern facilitating the turning, such as grooves or notches.

Figure 2:
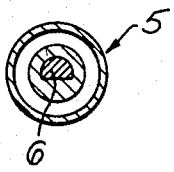
FIG. 2 shows a section at A-A in FIG. 1.

In accordance with FIGS. 1 and 2, the press knob 5 is connected by means of a friction joint to the shaft 6 of the press knob 5 in view of facilitating re-calibration of the pipette. If such a pipette with adjustable volume is concerned in which the adjustment takes place by turning the press knob 5, the press knob 5 must be attached to the press knob 5 shaft 6 nonrotably, as comes out from FIG. 2.

Figure 6:
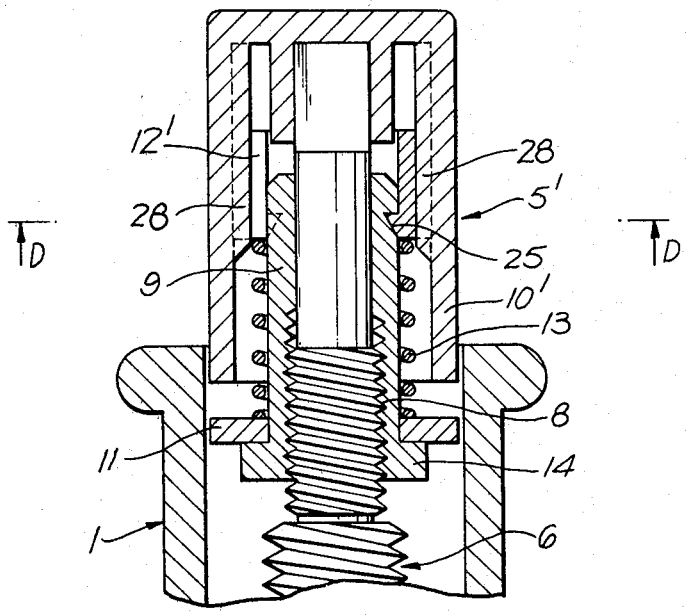
FIG. 6 shows an advantageous solution for the locking of the calibration sleeve in the construction of the upper part of the pipette shown in FIG. 1.
Figure 7:
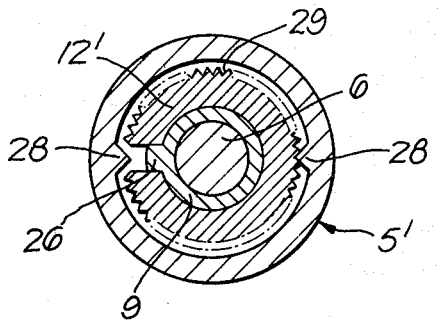
FIG. 7 shows a section at D-D in FIG. 6.

When the pipette is to be calibrated, the press knob 5 is first pulled apart from the shaft 6 of the press knob. Thereupon the calibration can be performed simply by, by means of the ring piece 12, turning the calibration sleeve 9 to the desired position either clockwise of anticlockwise. The calibration sleeve 9 can be locked into its position on the thread 8 of the press knob shaft 6, e.g., by means of a lock ring, counter-nut, friction, glueing, soldering, or by clenching the materials of the calibration sleeve 9 and of the press knob shaft 6 in relation to one another. According to FIGS. 6 and 7, the above locking of the calibration sleeve 9 as unrotable in relation to the press knob shaft 6 can be accomplished favourably by the intermediate of a press knob 5'. Thereby, the press knob 5' must be attached to the press knob shaft 6 unrotably in the way shown in FIG. 2. The outer face of the ring piece 12', connected unrotably to the calibration sleeve 9, is provided with vertical grooves 29, and the inner face of the mantle 10' of the press knob 5' is provided with vertical locking wedges 28, as means jointly operative with the said grooves 29 and as positioned in the way shown in FIGS. 6 and 7. If the press knob 5' is pulled apart, the calibration sleeve 9 can be turned in relation to the press knob shaft 6 by the hand by means of the ring piece 12', whereby the grooves 29 facilitate the turning. After calibration, the press knob 5, 5' is pushed into position onto the upper end of the press knob shaft 6.

For adjusting the volume of the pipette, the press knob 5 is turned, whereby the shaft 6 of the press knob rotates inside the sleeve 3 and shortens or lengthens the stroke length of the piston 3. When the press knob 5 of the pipette is depressed by the thumb, first the sleeve 20 is detached from the limiter flange 22, and the movement goes on until the annular flange 11 meets the top face of the limiter flange 22. If the press knob 5 is depressed further with a higher force, overcoming the prestressing of the spring 13, the movement goes on as a so-called secondary movement until the skirt of the mantle 10 of the press knob 5 meets the top face of the annular flange 11.

Figure 5:
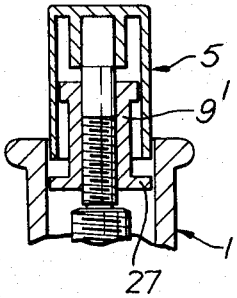
FIG. 5 shows an embodiment alternative for the construction of the upper part of the pipette shown in FIG. 1.

In FIG. 5, an embodiment of a pipette is shown that does not have a secondary movement at all. In that case, inside the press knob 5 into the calibration thread on the shaft 6 of the press knob, only the calibration sleeve 9' has been threaded, whereby, when pipetting is performed, the stationary limiter flange 27 at the lower end of the calibration sleeve 9' determines the stroke length of the piston 3.

What is claimed is:

1. An improved pipette comprising:

(a) a hollow frame portion forming a handle, said frame portion including an upper opening and an inner surface at its upper end;

(b) a cylinder formed within said frame portion;

(c) a piston displaceably and sealably fitted within said cylinder;

(d) a piston rod coupled to said piston for displacing same;

(e) a threaded shaft disposed within said frame including an upper portion and a lower portion, the lower portion of said shaft engaging said piston rod to displace same;

(f) a calibration sleeve threaded to the upper portion of said threaded shaft to permit the total length of said sleeve and said threaded shaft to be adjusted by relative relation thereof to thereby determine the lower limit of displacement of said piston; and (g) a hollow press knob coupled for displacement with said threaded shaft and extending out of said upper opening in said frame, said press knob including depending side walls forming a mantle, at least a portion of said calibration sleeve extending within said mantle of said press knob and being spaced apart from said mantle and said inner surface of said frame portion, the hollow press knob and the pipette frame forming a cover protecting said calibration sleeve from conducted heat by forming an air space about said sleeve.

2. The pipette as claimed in claim 1, wherein said press knob is coupled to said threaded shaft by means of a friction joint to thereby facilitate recalibration of said pipette by removal of said press knob.

3. The pipette as claimed in claim 1, wherein said press knob is coupled to said shaft non-rotatably.

4. The pipette as claimed in claim 1, wherein said calibration sleeve includes a first annular flange disposed at its lower end and a ring piece disposed at its upper end, a second annular flange slidably fitted about said sleeve and slidably fitted in the annular space between said calibration sleeve and said inner surface of said frame portion, a spiral spring disposed about said calibration sleeve between said lower flange and said ring portion to bias said second annular flange against said first annular flange.

5. The pipette as claimed in claim 4, wherein said inner surface of said frame portion includes a limiter flange for engagement with said second annular flange upon downward displacement of said threaded shaft and calibration sleeve.

6. The pipette as claimed in claim 4, wherein said ring piece is non-rotatable with respect to said calibration sleeve, whereby the calibration of the pipette may be performed by said ring piece by turning the calibration sleeve around said threaded shaft.

7. The pipette as claimed in claim 4, wherein said ring piece includes a cylindrical outer face including indentations to facilitate its turning.

8. The pipette as claimed in claim 4, wherein said ring piece includes a cylindrical outer face having vertical grooves disposed therein, the inner face of said mantle of said press knob being provided with vertical locking wedges coupling with said vertical grooves to lock the calibration sleeve into place by preventing the relative rotation of the press knob and the calibration sleeve.

9. The pipette as claimed in claim 8, wherein the inner face of the mantle of said press knob includes first and second locking wedges disposed in opposed relationship to each other.

* * * * *